US005529562A

United States Patent [19]

Glaser

[11] Patent Number: 5,529,562

[45] Date of Patent: Jun. 25, 1996

[54] EXERCISE APPARATUS

[75] Inventor: Jacqueline Glaser, Essex, United Kingdom

[73] Assignee: Rapesco Group, London, United Kingdom

[21] Appl. No.: 244,861

[22] PCT Filed: Dec. 16, 1992

[86] PCT No.: PCT/GB92/02327

§ 371 Date: Aug. 16, 1994

§ 102(e) Date: Aug. 16, 1994

[87] PCT Pub. No.: WO93/11832

PCT Pub. Date: Jun. 24, 1993

[30] Foreign Application Priority Data

Dec. 16, 1991 [GB] United Kingdom ..... 9126670

[51] Int. Cl.[6] ..... A63B 23/10

[52] U.S. Cl. ..... 482/146; 482/123; 482/133

[58] Field of Search ..... 482/123, 121, 482/129, 146, 147, 133, 120, 122, 124, 126, 127, 130

[56] References Cited

U.S. PATENT DOCUMENTS

| | | | |
|---|---|---|---|
| D. 255,372 | 6/1980 | Tidmore | 482/146 |
| 393,265 | 11/1888 | Rice | 482/123 |
| 1,911,572 | 5/1933 | Hulander et al. | 482/146 |
| 2,829,891 | 4/1958 | Ludwig | 482/146 |
| 4,273,327 | 6/1981 | Nall et al. | 482/146 |
| 4,491,318 | 1/1985 | Francke | 482/147 |
| 4,752,067 | 6/1988 | Colonello | 482/140 |
| 4,787,630 | 11/1988 | Watson | 482/146 |
| 4,966,364 | 10/1990 | Eggenberger | 482/146 |

*Primary Examiner*—Jerome Donnelly
*Attorney, Agent, or Firm*—Evenson McKeown Edwards & Lenahan

[57] ABSTRACT

An exercise platform mounted on a support structure with a curved base, so that the platform can rock between two end positions. The platform being adapted so that a person can exercise thereon. The curved base ensures that the person maintains a preferred posture while exercising. Normally, the exercises will utilize an elastic tied to the platform.

11 Claims, 2 Drawing Sheets

EXERCISE APPARATUS

BACKGROUND AND SUMMARY OF THE INVENTION

This invention relates to exercise apparatus for use in a gymnasium or domestic situation and is particularly but not exclusively intended to enable a user to exercise in accordance with a predetermined programme.

It is known to carry out exercises in a predetermined sequence, and in one technique, known as circuit training, one exercise consists of stepping one and off a step or low bench a certain number of times, which essentially exercises the leg muscles only. It is also known to use springs in the form of coil springs or elongate lengths of rubber, colloquially known as elastics, to strengthen the muscles of the upper body, particularly the arms. One name for such devices is chest expanders.

The present invention seeks to provide an improved apparatus which not only combines the benefits of the above two exercises but also requires the user to maintain a correct posture while exercising which greatly increases the benefits to be derived.

According to the present invention there is provided an exercise apparatus including a platform adapted to enable a person to stand thereon, characterised in that the apparatus includes a platform base having a curved ground interface surface to enable the platform to rock between two end positions.

In a preferred embodiment, at least one resilient exercise element is adapted to be used by said person in cooperation with the platform. A plurality of orifices can be provided in the platform and said exercise element comprises an elongate member or "elastic" that is adapted to pass through two of said orifices such that a central portion of the elongate member is adjacent the underside of the platform, so that the ends of the elastic which are held by the said person are at a desired spacing. Preferably, the orifices extend at spaced intervals along the two longitudinal edges of the platform, but they can be in other positions. Each orifice may have mounted therein a rotatable member to enable the elastic to run smoothly with little friction through the orifice. The rotatable member may be mounted so that its axis of rotation is pivotable in the plane of the platform.

Other objects, advantages and novel features of the present invention will become apparent from the following detailed description of the invention when considered in conjunction with the accompanying drawings.

DETAILED DESCRIPTION OF THE DRAWINGS

Figure 1:
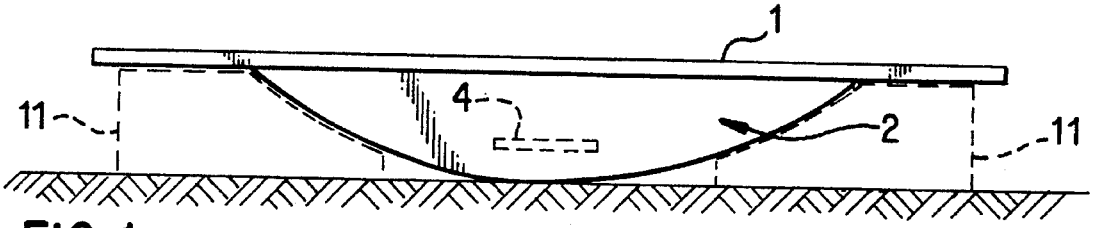
FIG. 1 shows a side view of an exercise apparatus.
Figure 2:
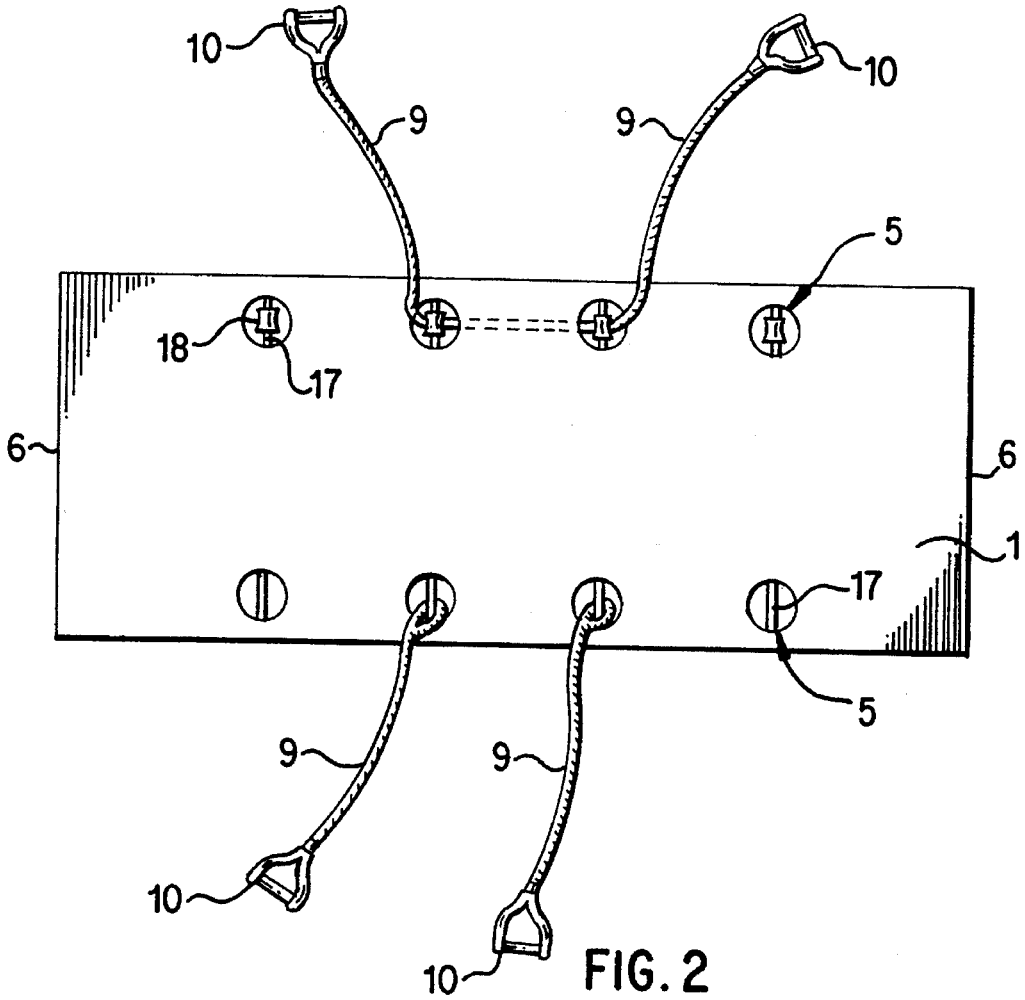
FIG. 2 shows a plan view of FIG. 1.
Figure 3:
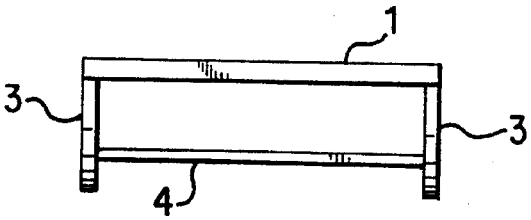
FIG. 3 shows an end view of FIG. 1.

Referring now to FIGS. 1 to 3, the exercise apparatus comprises a platform (1) on which the exerciser stands, which is mounted on a base (2) consisting of two arcuate members (3) fastened to the platform (1) adjacent the longitudinal edges thereof. A reinforcing strut (4) extends between the two members (3) at a position remote from the platform (2). In this embodiment, the platform (1) is approximately 95 cm by 45 cm and the height of the platform surface above the ground is 15 cm. The members (3) of the present embodiment are arcuate with a chord length of approximately 72 cm and a height of 13–14 cm. The ground interface surface of the members (3) is covered with a suitable type such as a plastic strip or foam strip to give the required degree of resistance to twisting and slipping and will also allow a degree of resilient damping. The members (3) may be aligned to fold flat for storage purposes.

As shown in FIG. 2, the platform (1) has a plurality of orifices (5) at spaced intervals along its longitudinal side edges. Typically, four orifices 5 cm in diameter are spaced 15 cm apart, the outer ones being approximately 20–22 cm from the ends (6) of the platform. Each orifice (5) contains a concave roller (18) rotatably mounted on a shaft (17) which extends transversely across the platform (1). Elastics (9), of which more than one may be provided and which may be of different lengths and strengths, are passed through selected ones of the orifices (5) as shown in FIG. 2, depending upon the type of exercise being undertaken. The rollers (18) enable the elastics to pass freely through the orifices (5) with minimal friction. The elastics (9) have a handle (10) at each end and may be color coded for length and strength.

Figure 4:
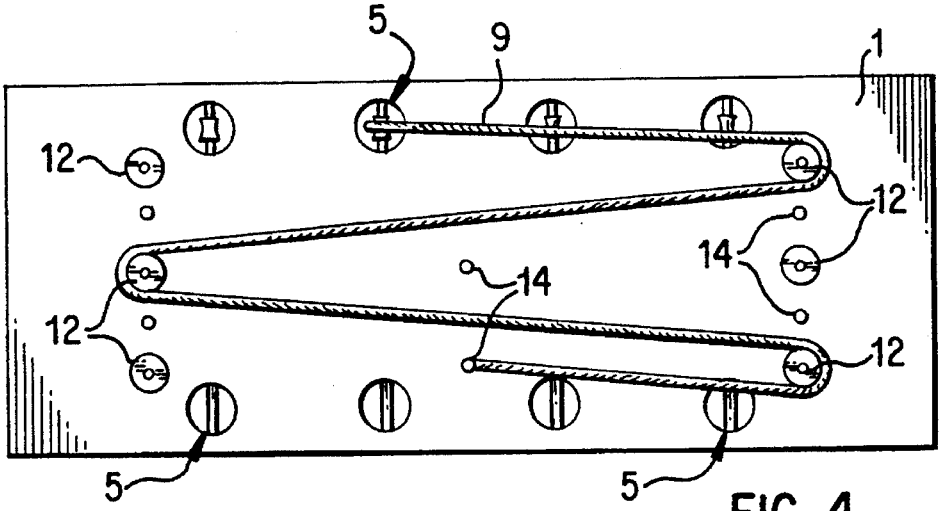
FIG. 4 shows an underneath view of an alternative elastic arrangement.

Referring to FIG. 4, there is shown the underside of an alternative form of platform (1) which has a plurality of capstans (12) located at spaced intervals. A long elastic (9) passes through one of the orifices (5) and round a number of the capstans (12), its end being secured at anchor point (14) to the platform (1). The use of a longer elastic has the advantage that for a given extension, the applied load does not increase to the same extent as it would for a shorter elastic. In this embodiment, the exerciser can adjust the length and strength of the elastic (9) to suit the exerciser or the exercise, by varying the length and/or elasticity of the elastic (9) and/or the capstans (12) about which the elastic (9) is passed and/or the anchor point (14) to which the elastic (9) is fixed.

Figure 5:
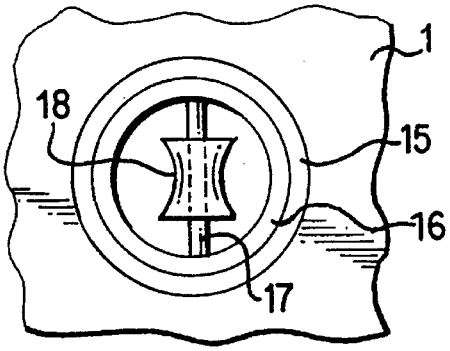
FIG. 5 shows an enlarged plane view of a preferred embodiment for the orifices of FIG. 2.

FIG. 5 shows a preferred arrangement for the orifices (5) consisting of an outer annular mounting (15) which is secured in the platform and within which there is mounted an inner ring (16) rotatable in the plane of the platform (1). The ring (16) carries a shaft (17) on which a concave roller (18), around which the elastics (9) run, the concave roller being rotatable about the axis of the shaft (17), i.e. rotatable about an axis in the plane of the platform (1).

Figure 6:
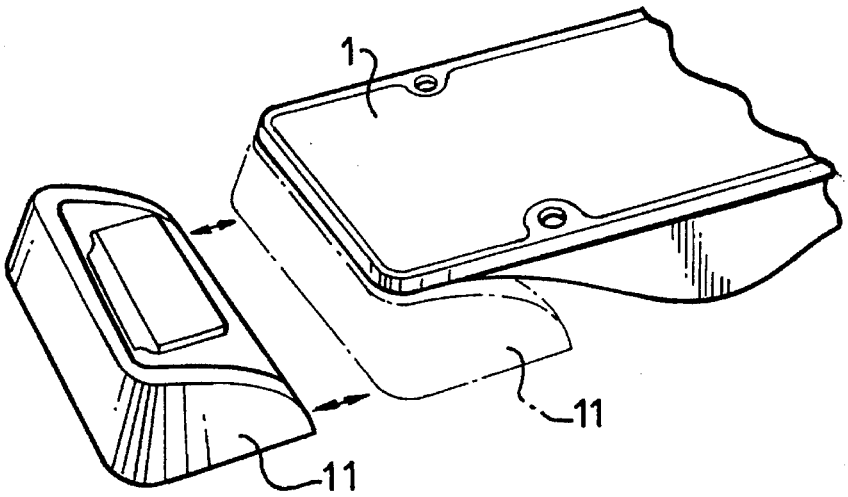
FIG. 6 shows a side perspective view of a preferred embodiment of the invention.

As shown in FIG. 6 and in dotted outline in FIG. 1, removable stops in the form of shaped supports (11) may be provided for those occasions when the pivotal movement of the platform (1) is not required. Each block (11) has a tongue that is securable in a catch device (not shown) on the underside of the platform (1). The catch device is often is normally in the form of a resilient clip arrangement. However, it will be understood that the blocks (11) could be incorporated into the platform (1) itself, being pivotable by means of hinges to a stop position.

Resilient stops (not shown) are provided under each of the ends 6 of the platform (1), to damp the impact of the ends (6) on the ground. The resilient stops reduce the noise produced by the apparatus and also reduces damage caused to the exercise floor. Also, the resilient stops reduce the amount of jarring of the person exercising, thereby reducing injury caused by impact, especially to the knee joints.

As will be seen from FIG. 6, the bottom surface of the members (3) are preferably in the form of a complex curve, such as a parabola. However, in a preferred embodiment, the extent of the bottom surface which can engage with the ground is generally arcuate.

In use, the exerciser stands on the platform (1) with feet spread apart so that the platform (1) is rocked from side to side by changing the position of the body mass. This action demands a correct posture which, in conjunction with appropriate movement of the elastics (9), enable a better form of exercise, and particularly better exercise routines, to be undertaken than is possible with the previously known apparatus.

I claim:

1. Exercise apparatus in kit form comprising:

a platform extending longitudinally and transversely and being adapted to enable a person to stand thereon, said platform including a platform base having a ground interface surface which is curved to enable the platform to rock between two end positions, at least one resilient exercise element adapted to be used by a person in cooperation with the platform, said at least one resilient exercise element including an elongate member secured to the platform, anchor means located on the underside of the platform, wherein the elongate member passes through an orifice in the platform and is secured at said anchor means such that a predetermined length of the elongate member extends on the upper side of the platform.

shaped supports which are selectively removably engageable with the underside of the platform to prevent rocking movement of said platform, and a plurality of capstans located on the underside of the platform, wherein the elongate member extends about at least one of said capstans to the anchor means.

2. Exercise apparatus according to claim 1, wherein said anchor means includes a plurality of separate anchors to which said elongate member can be selectively attachable to thereby change the effective predetermined length of the elongate member on the upper side of the platform.

3. Exercise apparatus according to claim 1, wherein the elongate member extends about a plurality of said capstans to the anchor means.

4. Exercise apparatus according to claim 1, wherein the elongate member extends about three of said capstans to the anchor means.

5. Exercise apparatus according to claim 1, wherein said plurality of capstans are spaced apart from one another and in sufficient number to facilitate selection of different groups of capstans about which the elongate member extends to thereby vary the effective predetermined length of the elongate member on the upper side of the platform.

6. Exercise apparatus according to claim 5, wherein said anchor means includes a plurality of separate anchors to which said elongate member can be selectively attachable to thereby change the effective predetermined length of the elongate member on the upper side of the platform.

7. Exercise apparatus according to claim 5, comprising damping means provided on the underside of the ends of the platform.

8. Exercise apparatus according to claim 1, wherein said ground interface surface of said platform base is configured to permit rocking motion of said platform only about a longitudinally oscillating transverse axis.

9. Exercise apparatus according to claim 8, wherein said anchor means includes a plurality of separate anchors to which said elongate member can be selectively attachable to thereby change the effective predetermined length of the elongate member on the upper side of the platform.

10. Exercise apparatus according to claim 1, comprising damping means provided on the underside of the ends of the platform.

11. Exercise apparatus according to claim 10, wherein said ground interface surface of said platform base is configured to permit rocking motion of said platform only about a longitudinally oscillating transverse axis.

* * * * *